US009339939B1

(12) United States Patent
Haney

(10) Patent No.: US 9,339,939 B1
(45) Date of Patent: May 17, 2016

(54) DEVICE WITH FORCE MULTIPLYING MECHANISM

(71) Applicant: Daniel Haney, Yacolt, WA (US)

(72) Inventor: Daniel Haney, Yacolt, WA (US)

( * ) Notice: Subject to any disclaimer, the term of this patent is extended or adjusted under 35 U.S.C. 154(b) by 0 days.

(21) Appl. No.: 14/945,379

(22) Filed: Nov. 18, 2015

Related U.S. Application Data

(60) Provisional application No. 62/081,376, filed on Nov. 18, 2014.

(51) Int. Cl.
*B25B 27/14* (2006.01)
*B26B 17/02* (2006.01)
*B25B 7/12* (2006.01)

(52) U.S. Cl.
CPC .. *B26B 17/02* (2013.01); *B25B 7/12* (2013.01)

(58) Field of Classification Search
CPC ..... B25B 7/12; B25B 7/14; B25B 13/28; B25B 13/467
See application file for complete search history.

(56) References Cited

U.S. PATENT DOCUMENTS

| | | | | |
|---|---|---|---|---|
| 4,214,491 | A | 7/1980 | Martinmaas | |
| 4,599,795 | A * | 7/1986 | Yokoyama | B26B 17/02 30/188 |
| 8,286,461 | B2 * | 10/2012 | Hofmann | B25B 27/10 29/751 |
| 8,407,875 | B2 * | 4/2013 | Gray | B21F 15/00 140/123 |
| 2006/0043660 | A1 | 3/2006 | Ping | |
| 2006/0272458 | A1 * | 12/2006 | Kelly | B25B 7/123 81/367 |
| 2013/0014618 | A1 | 1/2013 | Wu | |

OTHER PUBLICATIONS

Klein Tools, Inc, PVC Cutter 50500 Parts Breakout, Klein Tools, Inc., Lincolnshire, IL 60069-1418.

* cited by examiner

*Primary Examiner* — Lee D Wilson
(74) *Attorney, Agent, or Firm* — Bert P. Krages, II

(57) ABSTRACT

A tool useful for clamping, cutting, and the like comprising at least two force multiplying elements which act upon a gear reduction hub that moves a first jaw towards a second jaw. The tool applies greatly multiplied force to the jaws by repeatedly advancing the force multiplying elements in ratcheting manner. The force is maintained in a substantially continuous manner by a separate locking pawl that engages a geared face.

9 Claims, 2 Drawing Sheets

DEVICE WITH FORCE MULTIPLYING MECHANISM

CROSS-REFERENCED TO RELATED APPLICATIONS

This application claims the benefit of provisional application 62/081,376 which was filed on Nov. 18, 2014.

FIELD OF THE INVENTION

The invention relates generally to the field of hand tools.

BACKGROUND OF THE INVENTION

Hand tools such as conventional pliers, bolt cutters, and cutting pliers are used for various tasks involving gripping, cutting, and clamping. Such tools typically consist of two levers that work in opposite directions with a fulcrum at the point where the levels rotate (i.e. both levers are first-class levers). The basic mechanical principle underlying such tools is that exerting force on the handles of a pair of pliers multiplies the force several times when it is exerted on the load. These basic are well adapted for common tasks and are in common use. However, there are applications in which it can be useful to multiply the force beyond the range made feasible by the simple levers associated with such tools. One such application is the cutting of a ring that has become too tight on a finger to be removed by slipping the ring off the finger. Rings are often too thick to permit cutting with simple lever-based tools. Likewise, the adoption of hard metals such as titanium, tungsten carbide, and platinum as materials for rings makes such rings very difficult to cut through.

Rings can become tight on a finger when an injury such as a fracture causes the adjacent tissue to swell. This can be very painful to the person wearing the ring and can restrict circulation, obstruct lymphatic drainage, and lead to additional swelling. There are various techniques for removing rings from injured fingers. In some cases, lubrication with soap and water is enough to permit twisting the ring off the finger. If the ring is too tight or the wearer is too much pain, a conventional ring cutter can be used to cut through a narrow ring band. Such cutters consist of a lever that slides a protective cutting plate under the ring while a miniature circular saw blade is lightly pressed onto the outer portion of the ring and rotated to saw through the ring band. Once the cut has been made, the ring may be bent apart and removed. Another technique is to use a high speed rotary tool with a sharp-edged grinder attachment in conjunction with a heat-resistant shield between the skin and ring. The increasing popularity of rings made from hard metals such a platinum and titanium, have made ring removal a more difficult task. For example, it can take several minutes to remove a ring made of platinum or titanium using a conventional ring cutter. Furthermore, rings made of tungsten carbide can be extremely difficult, if not impossible to cut. Such rings are typically removed by using locking pliers or a hammer to induce the ring to crack. Such methods lack precision and expose the person wearing the ring to further injury. Therefore, there is a need in the field for a tool that operates quickly and effectively to cut and remove rings of any type.

BACKGROUND OF THE INVENTION

The invention comprises a hand tool in the general configuration of pliers having gripping jaws or cutting edges. The invention can be used for gripping, clamping, or cutting objects. A critical feature of the tool is the use of force multipliers to transfer force from a hand lever to a gear reduction hub that is connected to one of the jaws. Force multipliers are devices that are able to provide greater output force than input force. Examples of force multipliers include levers, pulleys, screws, gears, and hydraulic pistons that are configured to increase output force.

For example, the preferred embodiment of the tool is a ratcheting cutter has force multipliers working together to produce sufficient torque to cut through any metal, including titanium. This kind of tool can readily be configured such that 52 lb-ft of torque at the handle will produce over 100,000 lb-ft of torque at the cutting head in a smooth and continuous progression of applied force. This cutting device can be used in a variety of fields, but is particularly suited for use as a ring cutter. In addition, such a tool can cut through fencing, pad locks, cable, and bolts. With a different head design, the tool can be used for gripping and clamping onto various surfaces.

The preferred embodiment of the tool is configured in the general form of a hand tool having a pair of handles of which the lower handle acts as a lever, being joined to a double fulcrum force multiplier that is connected to an engagement pawl. By applying force to the lower lever it substantially increases the force applied to a pawl, which in turn rotates a gear hub which acts as another force multiplier. By pushing a detentable button at top of tool, a slide will move down the back of cam release slide and cause a locking pawl to engage the hub. When the locking pawl is engaged, a spring in the pawl ejects the pawl from gears and allows the gear hub to rotate forward in a ratcheting manner as the handles are repeated squeezed together and released. This causes the upper jaw at the opposing end to advance towards the lower jaw in a controlled manner for clamping or cutting. When finished, the user may push the detentable button on the top of the tool to a different position, thus causing the slide to disengage the locking pawl from the gear hub, thus allowing the tool to return to a reset position.

The tool can also be made using other combinations of force multipliers to apply force to a gear reduction hub. For example, in another embodiment, the lower handle can be squeezed to drive a bar having a pawl at its end into the teeth of gear which in turn drives the gear reduction hub to rotate in a forward direction.

DETAILED DESCRIPTION OF THE PREFERRED EMBODIMENT

Figure 1:
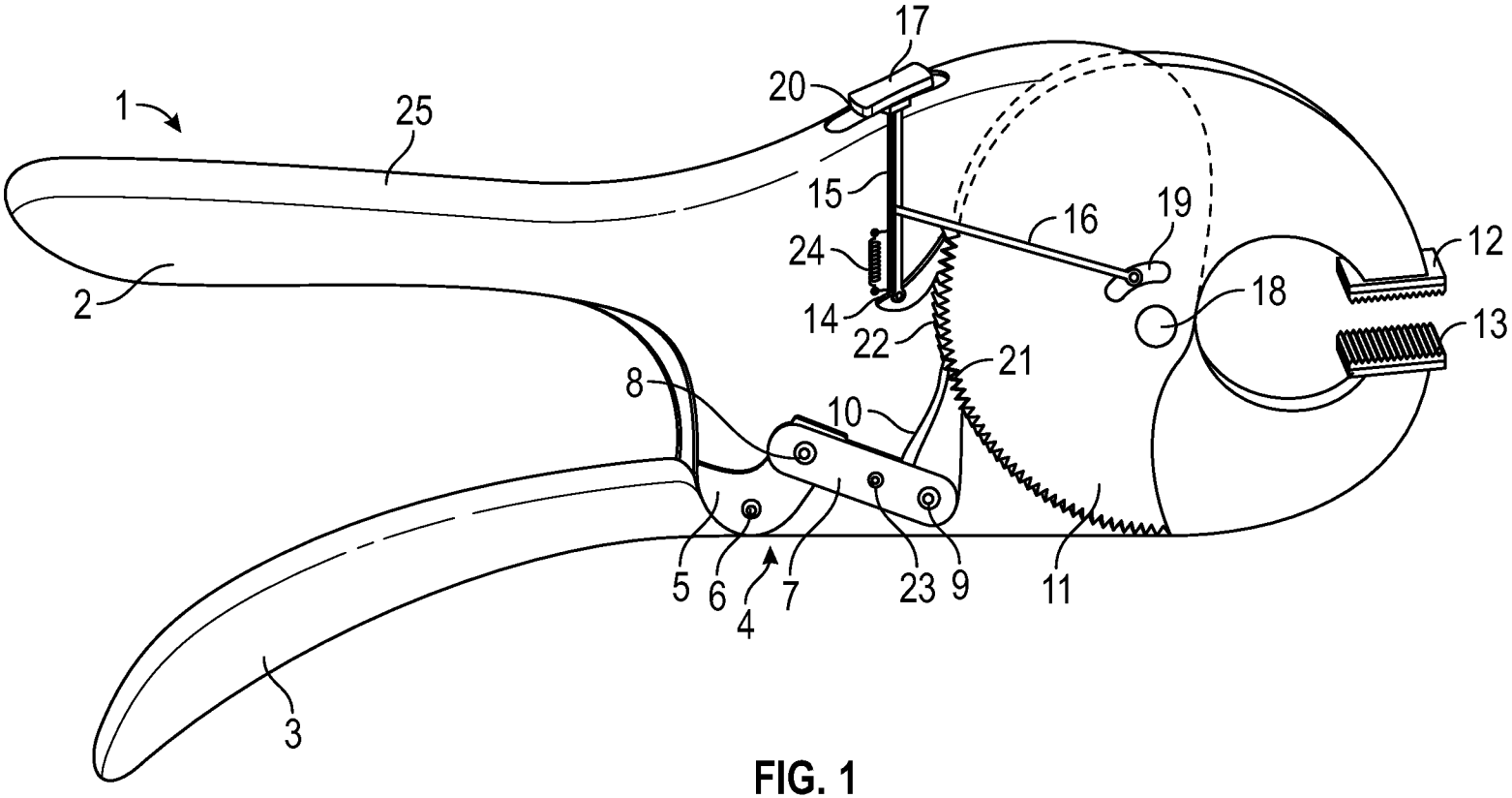
FIG. 1 is a side view of one embodiment of hand tool.

The preferred embodiment of the hand tool 1 is shown in FIG. 1. The tool 1 has a base member 2 that encompasses the upper handle and head portion of the tool 1. A lower handle 3 has a distal end 5 that is attached to the base member 2 by a pin 6 and to a connecting lever 7 by another pin such that the lower handle pivots about pin 6. The connecting lever 7 is attached to the base member 2 by a pin 23 such that the center of the connecting lever 7 pivots about pin 23. The connecting lever is further attached by a pin 9 to an advancing pawl 10 that has a toothed face 21. The assembly of the lower handle 3, connecting lever 7, and advancing pawl 10 form a double fulcrum thus creating a mechanical advantage that substantially multiplies the force applied to the pawl when the lower handle 3 is squeezed towards the upper handle of the base member 2.

A gear reduction hub 11 is attached to the base assembly by a pin 18 about which it pivots. The gear reduction hub 11 has a geared face 22 with teeth that are configured to engage with the toothed face 21 of the advancing pawl. When the lower handle 3 is squeezed towards the upper handle of the base member 2, the engagement of the advancing pawl with the geared face 21 creates an additional mechanical advantage causing the gear reduction hub 11 to pivot about pin 18 and thus moving the upper jaw 12 of the tool towards the lower jaw 13. The amount of throw in the movement of the assembly of the lower handle 3, connecting lever 7, and advancing pawl 10 is fairly short, and thus a user will generally need to squeeze the lower handle 3 towards the upper handle 25 several times to cause the upper jaw 12 to move from a fully open position to a closed position in which the upper jaw touches the lower jaw 13.

Retrocession of the gear reduction hub 11 during advancement is prevented by engagement of a locking pawl 14 with the geared face 22 of the gear reduction hub 11. This ensures a continuous application of force by the upper jaw 12 as the tools clamps or cuts material. A compression slide 15 is pivotably attached to the locking pawl at one end and to a release button 17 at the other end, which fits over a slot 20 in the base member 2. A spring 24 maintains a bias force on the locking pawl to keep it pressed against the gear face as the gear reduction hub 11 is advanced towards a closed position.

A bar 16 pivotally connects the middle of the compression slide 15 to a hole or slot 19 in the gear reduction hub 11. By pushing the release button 17 forward, the compression slide forces the locking pawl 14 to engage the geared face. Pushing downward on the release button 17 forces the compression slide to push down on the base of the locking pawl 14, thus causing it to disengage from the gear face 22. The disengagement is made easier if the lower handle 3 is squeezed lightly while depressing the release button 17. Pulling backward on the release button 17 causes the bar 16 to pull the gear reduction hub 11 to the open position and thus resets the upper jaw 12 to its starting position.

The tool 1 can be fitted with different kinds of jaws 12 and 13 depending on the intended function of the tool 1. For example, as shown on FIG. 1, upper jaw 12 and lower jaw 13 are configured to enable the tool to be used as a clamp, crimping, or crushing device. The tool 1 can also be configured as a cutting device by fitting an upper jaw 116 and lower jaw 117 that have cutting edges. In addition, lower jaw 117 can be configured to act as an anvil which receives an upper jaw 116 having a cutting edge. This combination can be particularly useful when the tool 1 is used as a ring cutter, in which case the lower jaw 117 is best configured to have a thin profile, preferably 4 millimeters or less, that may be readily inserted between a finger and a ring. To use as an ring cutter, the tool 1 is opened and placed so that the lower jaw 117 is located between a finger and ring. The upper jaw 117 is manually advanced to make contact with object by squeezing the lower handle 3 causing the tool 1 to ratchet with amplified pressure to cut through the ring. If the band of ring is constructed of a material sufficiently thin and bendable, the ring can be removed by bending the ends of band outwards until the opening is wide enough to pass the ring off the finger. Otherwise, the tool 1 can be placed on the side of the ring opposite from the cut and making a second cut. Once the second cut is made, the ring can be removed from the finger by pulling off the two halves of the ring.

Figure 2:
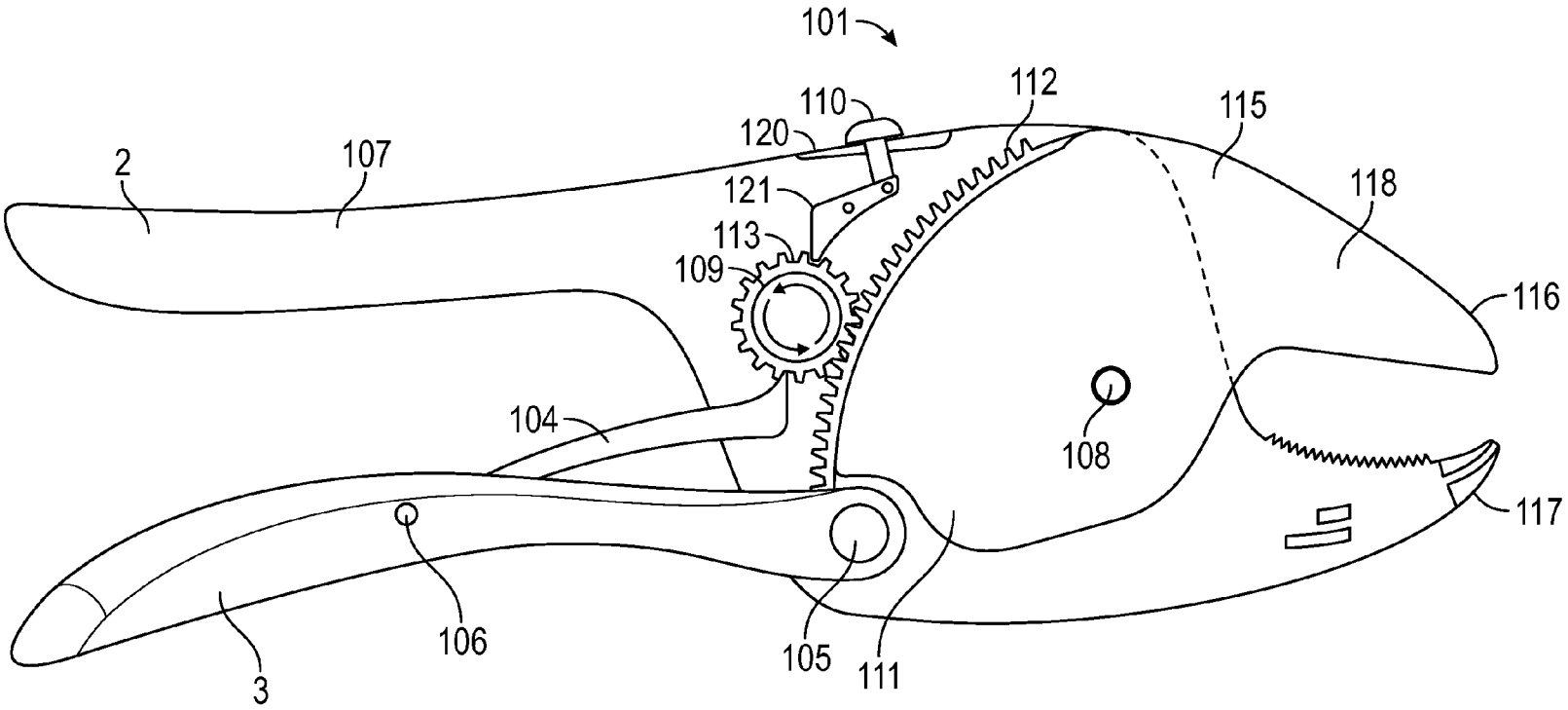
FIG. 2 is a side view of another embodiment of the hand tool.

An alternate embodiment of the hand tool 101 is shown in FIG. 2 in which a advancing bar 104 and advancing gear 109 replaces the double fulcrum mechanism shown in FIG. 1. In this embodiment, the lower handle 3 is attached to the base member 2 by a spring hinge 105 thus allowing the lower handle 3 to be squeezed towards the upper handle 107 of the base member 2 and returning to its original position by force exerted by the spring hinge 105. Another spring hinge 106 in the middle portion of the lower handle 3 exerts a bias force on the advancing bar 104 causing it to engage the advancing gear 109 when the lower handle 3 is squeezed towards the upper handle 107 and allowing advancing bar 107 to slide back over the teeth of the advancing gear 109 as the lower handle 3 is returned to its original position.

A pin 108 pivotably attaches the gear reduction hub 111 to the base member 2. The gear face 112 may extend past the bottom edge of the gear reduction hub 111 so that the gear reduction hub 111 does not interfere with the spring hinge 105. The upper jaw 116 may be an integral part of the gear reduction hub 111 or may be selectively detachable by putting a attachment point (not shown) in the region 118 that will not interfere with the base assembly member. In general, it is preferred that an attachment point not be located in an the area 115 where the attachment point might so interfere.

The advancing gear 109 is engaged with the gear face 112 on the gear reduction hub 111. When the lower handle 3 is squeezed towards the upper handle 107, the advancing bar 104 engages the advancing gear 109 and exerts a mechanical advantage while gear face 113 of the advancing gear 109 simultaneously engages the gear face 112 of the gear reduction hub 111 thus causing the gear reduction hub 111 to pivot about pin 108 and causing the upper jaw 116 to move towards the lower jaw 117. The radius length of the advancing gear 109 will determine both the extent of advancement of the gear reduction hub 111 when the lower handle 2 is squeezed as well as the magnitude of the mechanical advantage. A user will generally need to squeeze the lower handle 3 towards the upper handle 107 several times to cause the upper jaw 116 to move from an open position to a closed position in which the upper jaw touches the lower jaw 117.

The gear reduction hub 111 is prevented from receding during advancement by engagement of a locking pawl 121 with the advancing gear 109. The locking pawl 121 engages with the gear face 113 of the advancing gear 109. The locking pawl 121 can be selectively released and engaged from the advancing gear 109 by pushing a release button 110 forward and backward in the slot 120 in the base assembly 2.

Although the invention has been described with reference to a particular arrangement of parts, features, and the like, these are not intended to exhaust all possible arrangements or features, and indeed many other modifications and variations will be ascertainable to those of skill in the art.

I claim:

1. A tool comprising:

a base member having a fixed handle;

a second handle having a distal end and proximal end, and pivotably connected to said base member;

a gear reduction hub pivotably attached to the base member, said gear reduction hub having a geared face;

a first jaw fixed to said base member;

a second jaw fixed to the gear reduction hub, and configured to engage the first jaw when the gear reduction hub is pivoted in a forward direction;

a first force multiplier element operably connected to a second force multiplier element;

said first force multiplier element configured to be actuated by said second handle;

said second force multiplier element configured to apply force to said reduction gear hub to induce a forward rotation; and further comprising a selectively-engageable detent mechanism configured to resist backward rotation of the gear reduction hub when engaged and further configured to permit backward rotation of the gear reduction hub when disengaged.

2. The tool of claim 1 further comprising:

a connecting lever having a proximal end and distal end, which is pivotably connected to the base assembly at a point between said proximal end and said distal end of the connecting lever, in which said proximal end of the connecting lever is pivotably connected to the distal end of the second handle;

an advancing pawl having a toothed face end and which is pivotably connected to the distal end of the connecting lever;

in which said first multiplier element comprises the connection of the proximal end of the connecting lever to the second handle and the connection of the distal end of the connecting lever to the advancing pawl;

in which said second force multiplier element comprises the engagement of the toothed face of the advancing pawl to the geared face of the gear reduction hub.

3. The tool of claim 2 in which the first jaw is configured to have a cutting edge and the second jaw is configured with a thickness of 3.5 millimeters or less.

4. The tool of claim 2 in which the detent mechanism encompasses a locking pawl that engages the geared face of the gear reduction hub.

5. The tool of claim 2 in which the detent mechanism comprises a compression slide that is pivotably attached to a locking pawl at one end and to a release button at the other end, with the locking pawl engaging the geared face of the gear reduction hub.

6. The tool of claim 5 further having a bar pivotally connected to the compression slide at one end and connected to an opening in the gear reduction hub at the other end.

7. The tool of claim 1 further comprising:

an advancing bar having a connecting end and a pawl end, with the connecting end pivotably connected to the second handle;

an advancing gear, having teeth, said advancing gear being pivotably connected to the base member so that it may rotate;

in which said first multiplier element comprises the pawl end of the advancing bar in an engaged position with the teeth of the advancing gear;

in which said second force multiplier element comprises the teeth of the advancing gear in an engaged position with the toothed face of the advancing pawl to the geared face of the gear reduction hub.

8. The tool of claim 7 in which the first jaw is configured to have a cutting edge and the second jaw is configured with a thickness of 3.5 millimeters or less.

9. The tool of claim 7 in which the detent mechanism encompasses a locking pawl that engages the geared face of the advancing gear.

* * * * *